United States Patent [19]

Hefele

[11] 4,435,442

[45] Mar. 6, 1984

[54] METHOD AND APPARATUS FOR REINFORCING FACE FABRIC MATERIALS FOR GARMENTS

[75] Inventor: Josef Hefele, Gräfelfing, Fed. Rep. of Germany

[73] Assignee: Kufner Textilwerke KG, Fed. Rep. of Germany

[21] Appl. No.: 253,656

[22] Filed: Apr. 13, 1981

[30] Foreign Application Priority Data

Apr. 16, 1980 [DE] Fed. Rep. of Germany ..... 3014656

[51] Int. Cl.[3] ..... B05D 1/06; B05D 1/14

[52] U.S. Cl. ..... 427/14.1; 427/26; 427/200; 427/206; 2/97; 2/243 A; 2/272

[58] Field of Search ..... 427/14.1, 25, 26, 27, 427/200, 206; 2/97, 272, 243 A

[56] References Cited

U.S. PATENT DOCUMENTS

| | | | |
|---|---|---|---|
| 3,079,212 | 2/1963 | Fountain et al. | 427/200 |
| 3,101,273 | 8/1963 | Wagner et al. | 427/206 |
| 3,130,065 | 4/1964 | Manning et al. | 427/206 |
| 3,262,128 | 7/1966 | Morgan et al. | 2/272 |
| 3,336,149 | 8/1967 | Fox et al. | 427/206 |
| 3,370,569 | 2/1968 | Runge | 427/27 |
| 3,551,178 | 12/1970 | Chmelar | 427/27 |
| 3,681,108 | 8/1972 | Lewis et al. | 427/206 |
| 4,048,001 | 9/1977 | Remley | 427/206 |
| 4,122,219 | 10/1978 | Fickeisen et al. | 427/26 |

*Primary Examiner*—John H. Newsome

*Attorney, Agent, or Firm*—Scully, Scott, Murphy & Presser

[57] ABSTRACT

In a first operating stage, the back of a face fabric material is imprinted with a flock-binding aqueous cross-linkable dispersion paste in a grid-like manner by an intaglio printing process, flock is electrostatically applied to the paste, and the paste is then pre-stabilized by thermal coagulation and/or pre-drying. In a further operating stage, in which the material is preferably formed into a stack, the paste is cross-linked in a heated chamber at 90 to 140° C. Steps such as sewing and ironing may be interposed between the above-mentioned stages.

24 Claims, 5 Drawing Figures

METHOD AND APPARATUS FOR REINFORCING FACE FABRIC MATERIALS FOR GARMENTS

FIELD OF THE INVENTION

The invention relates to a method of reinforcing face fabric materials for garments by imprinting the back of face fabric materials in a grid-like or matrix-like manner, in particular cut face fabrics, such as front part cuttings, sleeve cuttings, collar cuttings and pocket flap cuttings, with cross-linkable aqueous dispersion pastes in an intaglio printing process. The invention is to provide a substitute for inserts which is to help in reducing considerably the costs of the previous insert insertion process. Furthermore, the invention relates to apparatus for performing this method.

PRIOR ART

British Patent Specification GB No. 1 201 941 describes the matrix-like imprinting of synthetic resin pastes upon the back of a face fabric cutting as a substitute for insert materials. The imprint is effected by means of a screen stencil. A different imprinting apparatus is necessary for each different cutting format of a garment. The directional dependence of the printed patterns is relatively low and as a rule lower than that of the warp and weft threads of an insert fabric. The technique could not find entrance into practice. The disclosure of German Specification DE-OS No. 25 52 878 tries to circumvent the disadvantages by imprinting patterns having a strong directional dependence, for example by imprinting discontinuous and continuous lines.

In order to avoid a multitude of imprinting devices, the said German Specification proposes to use in the first place the intaglio printing process and under certain circumstances to move the printing rollers during the printing process into and out of contact with the fabric article travelling through, whereby selectively zones with and without imprint can be produced. Also printing masks are suggested. However, bar-like or line-like imprints for the purpose of producing a strong directional dependence were part of the known prior art a long time before the appearance of the above-mentioned German Specification. For this purpose, for example, the hardly direction-dependent fleeces have for a long time been provided with heat-softenable adhesive masses, often imprinted in bar form, and line-shaped imprints of reaction-hardening dispersion pastes have been described, for example in Austrian Patent Specification OE-PS No. 341 466, in order to provide inserts and other materials with directional dependence.

The most important disadvantage of the synthetic resin reinforcement on the back, be it with more or less pronounced directional dependence, is not removed by the two inventions just mentioned. It is recognizable as a considerable disadvantage that a face fabric cutting which is merely reinforced by imprinting thereon a mass of synthetic resin, does not attain the full-textile grip that is the property of a face fabric material provided with an insert material. The face fabric material provided solely with a synthetic resin reinforcement has a board-like and flat effect, in particular when the still unreinforced face fabric material is already of a low fullness or the imprinted mass of synthetic resin penetrates into the face fabric material. A further disadvantage of face fabric materials with a synthetic resin imprint layer on the back as known heretofore is their considerably reduced ironing and dressing ability. Owing to the effect of relatively high temperatures of 150°–160° C. over a comparatively long treatment period of up to approximately 5 min, the synthetic resin coating is transferred to a state having merely a low thermoplasticity and moreover the face fabric material is completely dried out, whereby subsequent ironing and dressing processes can only be performed with increased difficulty. Also, changes of colour hue may take place. Likewise of disadvantage are the low printing capacity, the high energy expenditure, and the necessary over-dimensioning of the drying and condensing (curing) portion of the printing installation. At a length of the dryer of 5 m the conveyance speed may, for example, only amount to 1 m/min.

On the other hand, the high saving effect which can be expected from a sole printing treatment of the face fabric material, has already been under discussion for a long time, and qualitative advantages also, such as for example the exclusion of shrinkage differences, are an incitement to look for a substitute method by immediate imprinting of a suitable reinforcing agent, particularly by the intaglio printing process, which is richer in variations than the screen printing process.

The above-described German Specification DE-OS No. 25 52 878, at page 14, para. 2, mentions by the way the deposition of short-fiber flock upon an imprinted layer which contains relatively coarse-grained talcum powder as a print-improving filling agent. However, tests have shown that no approximately sufficient anchoring of the fibers is obtained by pouring on. Upon friction, under the effect of moisture and during chemical cleaning the fibers drop off. Also, the thickness of the face fabric material is only increased to an immaterial extent by mechanically depositing the flocks, and additionally the reinforcing layer tends heavily to chalk-release originating from the incorporated talcum powder.

Electro-static flocking using flock binding agents consisting of cross-linkable aqueous dispersion pastes is already known per se. However, electrostatic flocking as such, as a rule, requires accurate selection and careful preparation treatment of the carrier material to be flocked, and for qualitative reasons flock binding agents are nowadays used (in place of cross-linkable aqueous dispersion pastes) from which solvents or other chemicals are expelled during drying and condensing. Such flock binding agents are hardly —if at all—suitable for the intended purpose of use in the garment industry. Tests performed by the present Applicant have led moreover to the result that by electrostatic flocking alone, be it in combination with the talcum described as a print improver, satisfactory properties are not obtainable in respect of a combination of grip, flock anchoring, printing behaviour, etc.

Therefore, there is a demand for the provision of a method as well as suitable apparatus which yield on as high as possible a percentage proportion of the face fabric materials used in the garment industry, a clear, accurately contoured printed image, but also a satisfactory wear resistant, wash resistant, and chemical cleaning-resistant anchoring of the binding agent on the back of the face fabric material as well as possibly inserted auxiliary substances, with a grip behaviour that corresponds more closely to a face fabric material reinforced by an insert.

OBJECT OF THE INVENTION

The basic object of the invention is to provide a method which retains the advantage of the intaglio printing process and avoids a board-like textile grip, as well as apparatus therefore, which satisfies also the further criteria referred to above. In particular the method should be employable for as wide as possible a selection of face fabric materials without change of the printing apparatus and the reinforcing material used. A further object of the invention is a production method which excludes long dwelling periods at high temperatures, reduces the expenditure of energy, increases the coating capacity, and restricts the size of the installation.

SUMMARY OF THE INVENTION

Surprisingly it has been found that this can be achieved by a method, of the kind referred to above, in which in a first operating stage face fabric material cuttings are (a) imprinted with a flock-binding cross-linkable dispersion paste, (b) this dispersion paste is electrostatically flocked, (c) thereafter pre-stablized by heat coagulation and/or pre-drying, and finally in a further operating stage (d) final condensing (cross-linking or curing) is effected in a heated chamber at 90°-140° C., preferably at 100°-130° C.

With these measures the reinforced face fabric material part has a fuller and more textile effect and more closely resembles a face fabric material part reinforced with an insert, than a part which is merely reinforced in a grid-like or matrix-like manner by synthetic resin masses.

The flock-binding cross-linkable dispersion paste has preferably highly disperse filler substances incorporated therein which ensure a contour-shape imprint on a comprehensive range of face fabric materials of the garment industry and simultaneously a satisfactory connection between the paste and the face fabric material as well as with the fiber flocks.

It is surprising that the proposed addition of highly disperse filler substances which, as will be described further below, possess vey small particle sizes with a large specific surface area, ensures in combination with the other measures by the intaglio printing process a contour-shape imprint on a particularly manifold range of face fabric materials, satisfactory anchoring of the layer of paste, but also of the flock fibers located therein. This is the more remarkable as the face fabric materials used in the garment industry and processed to articles of clothing vary extremely widely in the kind of the fiber materials, fiber thicknesses, fiber lengths, yarn thicknesses, yarn twists, bindings, yarn densities, fittings, colorings, and other treatments, but a specific pre-treatment of the back of the face fabric material is not provided in respect of the matrix-like flock coating, and highly disperse filler substances of the kind described below have not yet been proposed for the purposes of flocking.

The filler substances are employed with particular advantage in a quantity of from 0.5 to 5% by weight, but particularly preferred in a range of from 0.7 to 3% by weight, referred to the dry weight of the dispersion paste. Although it has been found that good results can be obtained with filler substances having an average surface area in the range from about 25 to 600 $m^2/g$, the employment of filler substance specifications having an average surface area in the range from 50 to 400 $m^2/g$ is particularly advantageous. It is further of importance that the highly disperse filler substances possess a very small particle dimension, in particular in the range from 7 to 80 nm, particularly advantageously in the range from 10 to 40 nm with approximately spherical particle configuration.

Within the scope of the invention it is also intended that the highly disperse filler substances are cleaning-resistant and friction-resistant. Therefore, in particular, this brings into consideration the use of such highly disperse inorganic filler substances whose Mohs hardness exceeds 6, and in particular lies in the range from 7 to 9.

Particularly favourable results may frequently be obtained by the use of such filler substances which had been produced by decomposition of the corresponding halogenides in the gaseous phase. For example reference is to be made here to the specifications of silicic acid aluminum oxide or titanium dioxide, which may be employed with particular advantage, and which have been obtained for example by hydrolysis of silicon tetrachloride, aluminum tricholoride, titanium tetrachloride, etc., in the gaseous phase.

The filler substance is preferably introduced additionally into the aqueous suspension which contains the cross-linkable components and under certain circumstances other auxiliary substances. It is preferred that the highly disperse filler substance, at least the major portion thereof, is not already present in the cross-linkable starting polymers. The required printing properties can be adjusted by additional introduction of the highly disperse filler substances.

Of the flock binding agents based on cross-linkable dispersion which are already used in the flocking technique and are commercially available, certain ones are particularly suitable and may be selected with advantage for the method according to the invention. The selection has to be made inter alia in accordance with the desired reinforcement of the grip, the penetration, the anchoring on the back of the face fabric material, the flock anchorage, the cleaning, washing, and friction resistance, and the ability to imprint as comprehensive as possible an assortment of the face fabric materials employed in the garment industry by the intaglio printing process used.

In general, the cross-linkable dispersion pastes may contain firstly in a preferred manner the co-polymerisates already used for flocking purposes, based on acrylic and methacrylic acid esters with water as the dispersing agent. Cross-linkable acrylonitrilebutadiene co-polymerisates, under certain circumstances with a styrene proportion, in a dispersed form are also suitable. Condensable cross-linkable components are also polymerised into the polymerisates. Polymerizable esters of the acrylic and methacrylic acid coming into consideration are for example methyl, ethyl, butyl, and isopropyl esters, and other esters of higher alcohols. In addition the cross-linkable polymerisates may contain built into them even other monomer compounds which can be polymerised in, such as acrylonitrile, free acrylic and methacrylic acid, maleic acid, fumaric acid, vinyl acetate, vinyl chloride, vinylidene chloride, ethylene. The cross-linking components polymerised into them may be so selected that they effect self-cross-linking of the polymer molecules amongst each other, or enter into cross-linking with added hardening agents. Self-cross-linkages are produced, for example, by monomethylol acrylic acid amide and monomethylol methacrylic acid amide, each built into the polymer molecule. Additional hardening agents are necessary e.g. with acrylic acid amide and methacrylic acid amide which are polymerised in.

The hardening agents which may also be added to the self-cross-linking polymerisates, may be represented by condensable water-soluble resins having free or alkoxylated methylol groups. These include carbamide resins (urea-formaldehyde resins), alkoxylated urea formaldehyde resins, melamine resins and melamine carbamide resins, semi-reactant resins, such as urone resins, triazone resins, and tetramethylol acetylene di-ureau, reactant resins, such as dimethylol ethylene urea, dimethylol propylene urea, dimethylol-5-oxypropylene urea, and 4-methoxy-5-dimethyl-N,N-dimethylol propylene urea, and carbamate resins. During the hardening process, the said water-soluble resins produce bridges between the polymerisates referred to above.

The stated co-polymerisates may be slightly cross-linked also during the polymerisation, for example by the introduction of divinyl compounds, such as butanediol-di-(meth)-acrylate, diallyl phthalate, methylenebisacrylamide, or divinyl benzene. The proportion of the divinyl compounds in the total polymerisate is not to exceed in general 3%. By the use of slightly pre-cross-linked co-polymers of this kind, the washing and cleaning resistance can be raised. An increase of the washing and cleaning resistance and an improved binding of the flock fibers may alternatively be obtained also by a pre-condensation of the cross-linkable co-polymerisates. By an addition of bifunctional hardening agents, such as dimethylol ethylene urea or dimethylol propylene urea in quantity proportions of up to a maximum of 4% referred to dry weights, frequently still storage-stable pre-cross-linked dispersions are produced in the acid medium of the co-polymerisates, which dispersions shorten also the condensation times or require lower condensation temperature, respectively. The suitable quantity proportions of the bifunctional hardening agents depend upon the co-polymerisate used. It can be easily established by means of preliminary tests what quantity proportion may be added without putting the storage ability at risk. Particularly favorable results can be obtained when additionally co-cross-linkable water-soluble foreign resins are present which have carbonic acid amide groups in the polymer molecule, e.g. polyacrylic acid co-polymerisates or water-soluble co-polymerisates with methacrylic acid amide groups. Referred to their dry content and that of the cross-linkable dispersed co-polymerisates, the proportion thereof should not be higher than 5%, with the simultaneous presence of the bifunctional hardening agents of 3% maximally, likewise referred to dry contents. In this case, too, preliminary tests will easily establish what quantity proportion thereof can be employed. In this case the presence of the highly disperse filler substances referred to above is imperative, in order to prevent penetration into the face fabric material, which penetration would otherwise be very strong. A simple method of producing such pre-condensates which also permits the manufacturer of the flock-binding dispersion a quality-improving possibility of intervention, resides in the addition of the bifunctional hardening agents by themselves or together with the polymer carbonic acid amides to the acid dispersion of the cross-linkable co-polymerisates at normal temperature and in leaving the preparation alone for a prolonged period of time, until the desired pre-condensation stage has been attained. Thereafter, neutralisation is effected and the formulation of the flock binder is performed. The addition of a further hardening agent is effected shortly prior to the printing and flocking process.

As a rule, the highly disperse filler substances referred to above are sufficient for thickening the dispersion pastes. However, alternatively additional or sole thickening of the dispersion pastes may be performed with usual non-ionic print thickening means, such as casein, modified casein, gelatin, starch, and its modifications, tragacanth, alginate, polyvinyl alcohols, polyvinyl pyrrolidone, cellulose ether, and high-molecular polyethylene oxide. Ionogenic thickening agents are also suitable, such as polymer carbonic acids.

In addition to the component parts referred to above, subordinate quantity proportions of polyurethanes may also be contained in dispersed form. The polyurethanes may possess end-standing groups which render them capable of cross-linking with the cross-linkable co-polymerisates and/or the hardening agents. The end-standing groups may be, for example, acid amide groups, OH groups, ketoxim-urethane groups, or blocked NCO groups which under heat release unblocked NCO groups.

As is usual with compositions of similar combination, cross-linking means, for example non-ionogene addition products of fatty alcohols or phenols and ethylene oxide, may also be additionally employed for stabilising the paste. Furthermore various additives likewise known per se, such as color-providing means, UV stabilisers, anti-oxidants, may be included. Advantageously, de-foaming agents may also be added thereto. Finally, hardening catalysts, such as acid providers, acid or metal salts, may also be additionally present, in order to accelerate the cross-linking process. Suitable acids are maleic acid, maleic acid anhydride, oxalic acid, citric acid, acetic acid, chloroacetic acid, sulfotoluenic acid. Suitable acid providers are their ammonium salts, ammonium chloride, ammonium rhodanide, ammonium nitrate, di-ammonium phosphate, and others. Suitable metal salts, finally, are magnesium chloride, zinc nitrate, zinc oleate, and complex salts. Polymeric acids, such as poly acrylic acid or poly methacrylic acid are also employable and have a catalysing effect either by themselves or together with other acids, acid providers, or metal salts.

The flocks are electrostatically "shot" into the aqueous cross-linkable dispersions. It is particularly preferable when the flock deposition occurs directly upon the grid-like matrix-like imprint of the dispersion paste: the operation may be effected e.g. with advantage in an electrostatic direct current power field having a tension in the range from 20,000 to 100,000 V. By means of the deposition of the flocks in an electrostatic manner at an instant of time at which highly disperse filler substance in as homogeneous a distribution as possible is already contained in the imprinted dispersion pastes, particularly favorable results may be obtained. Details of the flocking process may be gleened from the following example as well as the apparatus according to the invention. In this case it may be possible to vary the electrostatic flocking, dependently upon the field of application, within the scope of the electric flocking techniques known from other fields of application. It may also be advantageous to assist the electrostatic flocking by mechanical means by the generation of vibrations, for example by rotating beater shafts.

The quantity of the flocks used may be varied within certain limits depend upon the kind of face fabric material, but also upon the kind of face fabric material cutting, such as front part cutting, sleeve cutting, collar cutting, and pocket flap cutting. Favorable results are obtained when the flocks are supplied in a quantity of an average from 5 to 20% by weight, preferable in the range from approximately 7 to 15% by weight of the dry paste weight. Particularly optimal results are obtained by means of such flock quantities in conjunction with the control of their particle size and thickness, and also their composition.

The flocks anchored by means of the imprinted layer should possess a length of from 0.5 mm to a maximum of 2.0 mm. The fiber thickness should lie between approximately 0.9 and a maximum of 10 dTex, preferably between 3 and 8 dTex. The term dTex is well known in the art and is defined by the equation, $$dTex = [G(g) \cdot 10 \cdot ooo / L(m)]$$

where G(g) is the weight in grams and L(m) is the length in meters.

The concept is also called dezitex, and has the following relationship to the known U.S. concept denier: dTex.0.9=denier. Cut or ground fibers are employable, for example ground cotton fibers, ground and cut cellulose wool fibers, and synthetic fibers. Amongst the synthetic fibers, polyamide fibers are particularly preferred. The fiber flocks should normally have a treatment with an antistatic medium, in order to ensure perfect flocking in the electrostatic field.

The fiber flocks may possess their natural color or be naturally white, but alternatively they may be dyed in any desired color. As a rule naturally colored or naturally white flocks are sufficient.

Also, the deposition weight of the flock-binding paste depends in the first place upon the field of application, the kind of face fabric material or the cutting thereof, and upon the desired grip envisaged by the garment manufacturer. Suitable deposition quantities lie in ranges between 40 and 90 g/m$^2$, referred to the dry weight. The dry content of the paste to be taken into account in this case may vary in the range between 40 and 60%. The quantities of flock mentioned above are to be added to the said deposition weights.

Particular advantages may also be imported by the employment of heat-sensitive flock-binding pastes. The use of these favors a manner of working by which the energy requirement which is necessary for drying and condensing the flock-binding imprint can be considerably reduced. In the case of the proposals which have become known heretofore for the so-called "direct stablisation" of face fabric materials by imprinting thereon, in line form, synthetic resin masses which have a stiffening effect, high energy consumption is required for the conveyor belt installations provided, in the region around 70 kW, and very high condensation temperatures with low belt speed are necessary. in order to obtain a satisfactory finished condensation of the imprint. During deposition of the flock layers according to the invention rather even more unfavorable condensation conditions can be maintained, if as in the case of the previous proposals printing and condensation is effected in one step simultaneously on one belt installation.

In particular in the use of heat-sensitive flock-binding pastes which coagulate in the temperature range below 100° C. and preferably between 45° and 80° C., it is possible in the flock coating of face fabric materials to operate with a high saving of energy, increased production speed, and careful fiber treatment at milder temperatures. In the first stage, printing, flocking, and coagulating and/or pre-drying are performed on one belt installation. The face fabric material parts preliminarily prepared and preferably placed on a stack are then finally condensed (cured or cross-linked) in heated chambers in the second stage. According to this production method, substantially only the energy supply for heating to the coagulation temperature is necessary in the first stage. Since the condensation in the subsequent second stage is not performed singly, but in large quantity units stacked in a chamber, e.g. in a heat-insulated ambient air cabinet, the energy requirement therefore carries only relatively very little weight. Also the condensation temperature can be lowered with the avoidance of temperature damage and total drying-out of the fibers, with correspondingly lengthened condensation time, without it being necessary to take into consideration the belt speed and the deposition speed of the first production stage. For example, in the first stage a belt speed of approximately from 3 to 5 m/min is possible with a power consumption of around 20 kW, and the final condensation is performable between approximately 90° and 140° C. and preferably between 100° and 130° C., now with a selection of the condensation duration between for example 1 and 24 h. In contrast, a single stage manner of working would require perhaps a power consumption of around 70–80 kW, a condensation temperature around 150° to 160° C. and a belt speed of about 1 m/min, with a sensible machine size having a dryer length of approximately 5 m. Also, the machine expenses are reduced considerably with a two-stage method.

The preceding coagulation and pre-drying of the flock-binding paste of the first working stage permits trouble-free stacking of the flocked face fabric material cuttings.

The heatable chambers which are used for the finish condensation and into which the stacks may be inserted one above the other in the manner of drawers, the stacks having e.g. approximately 20–30 cutting parts, may consist of conventional drying cabinets which, if so required, may even be purged with an inert gas, such as nitrogen or carbon dioxide. A drying cabinet having the clear internal dimensions 90 cm deep, 100 cm wide, and 180 cm high can store 1500 front parts of a man's jacket, a quantity which, at a feed speed of a belt installation of 1.5 m/min, would correspond approximately to a printing capacity of 8 working hours. At a condensation temperature of the drying cabinet of approximately 105° C., for example a dwelling time of 12 h in the cabinet is sufficient, in order to obtain optimum washing, cleaning, and wear resistance. The cutting parts may be stacked flat one above the other and may be stored in the heated condensation chamber immediately after leaving the belt installation. However, it is also possible to perform the stacking between moulds, for example between moulds which correspond to the chest curvature of a jacket. After the expiry of the condensation treatment, the front part possess a largely fixed and in any case more stable shape than is possible for finished condensed imprinted front parts, but also front parts provided with inserts in the conventional manner, by dressing them afterwards. For a stack of 20–30 front parts merely 2 moulds, a support mould and a cover mould are necessary. The stack is embedded between the two during condensation. The two moulds may be constructed of metal, or alternatively of any other heat-stable material. Prior to the condensation treatment, ironing and sewing processes may also be interposed, for example processes for sewing and ironing the dart in the front part. These processes may be performed more easily prior to the finish condensation than later on and likewise render recognisable the advantage of the manner of working according to the invention.

It is clear from the preceding that it may be advantageous within the scope of the method according to the invention to use coagulation agents in order to obtain heat sensitisation of the dispersion paste, if the paste does not already contain heat sensitising components or can be heat sensitised in some other way, e.g. by change of the pH value, such as is the case with certain commercial cross-linkable polyacrylate dispersions which are latently thermo-sensitive. Suitable coagulation agents are able in this case to initiate, or to effect, respectively, coagulation in a temperature range of below 100° C., the use of such coagulation agents being preferred which leads to a coagulation even in the range between 45° and 80° C. Coagulation agents which may be used are for example polyvinyl methyl ether or high-molecular polyethylene oxide. When heat-sensitive flock-binding pastes are used, the advantages of the two-stage manner of working become particularly apparent, such as has been illustratively explained above already several times with reference to more concrete statements. In this case in general heating is effected first to a lower temperature for the purpose of coagulation and thereafter to a higher temperature for the purpose of hardening the coagulate. This manner of working may be rather economical as to the production on the one hand, and on the other hand it may also be advisable for the treatment of such face fabric materials which are particularly heat-sensitive; to these belong for example face fabric materials having a high proportion of acrylic.

According to a varient of the method, by which favorable results have been obtained, the face fabric cuttings are first heated on the belt installation of the first method stage to a temperature of approximately 80° C. or below with coagulation of the paste, and thereafter in the further working step they are brought to a temperature in the range from 90° to 140° C., preferably 100°–130° C., for the purpose of effecting the hardening or cross-linking.

The use of heat-sensitively adjusted flock-binding pastes is not necessary in every case. Non-heat-sensitive pastes also, which are merely pre-dried and under certain circumstances slightly condensed, import the stated advantages, although not quite so strongly pronounced.

The heating may be effected dependently upon the duration—in general considerably shorter periods of time are required for the coagulation than for the hardening—by means of hot air, infra-red radiators, or micro-wave radiators. In this case a combination of these measures may even be advantageous, for example infra-red radiators arranged in a heating zone into which simultaneously hot air is blown or from which hot air is sucked away. The use of micro-wave radiators may be advantageous for heating the stacked face fabric cuttings to the condensation temperature prior to their introduction into the heated chambers, whereby the time required for heating the stack is shortened in an effective manner.

In some application purposes the use of foamable dispersons may also be advantageous; the foaming agent may be a conventional one whose decomposition takes place for example with the development of a gas. Alternatively, however, it is possible to control the driving gas, which leads to a partially porous synthetic resin matrix, by special variation of the suspending means or even by the kind of heating conditions. The employment of foamed dispersions may lead in particular to a saving of material, and sometimes also to an improvement of the grip properties without board-like stiffening.

The method according to the invention will now be described in detail with reference to an example. This example constitutes a preferred form which, however, may be varied appropriately within the scope of the teaching provided herein.

EXAMPLE

A printing paste suitable for the intaglio printing and flocking method according to the invention is produced in the following way:

There are mixed:

- 400 parts by weight: Plextol DV 300 (=60% cross-linkable aqueous polyacrylate dispersion, containing N-methylol carbonic acid amide groups, containing acrylonitrile, very soft pH value 2.5. Manufacturer: Röhm GmbH, Darmstadt)
- 40 parts by weight: 20% polyacrylic acid amide solution in water
- 12 parts by weight: 40% solution of dimethylol propylene urea in water.

The mixture has a pH value of approximately 3.2. After standing for 8 days at room temperature the mixture is adjusted to pH 8 by means of concentrated ammonia. The dispersion, which is then pre-condensed and is sufficiently stable for storage, is mixed at room temperature in an evacuated rapid mixer with

- 5 parts by weight: highly disperse silicic acid produced by flame hydrolysis of $SiCl_4$ (surface area approximately 200 $m^2/g$), and
- 1 part by weight: mineral oil de-foaming agent.

Shortly prior to use:

- 23 parts by weight: 60% aqueous solution of alkoxylated melamine resin are stirred in homogeneously. The dispersion paste obtained is then usable for printing and flocking.

The following viscosities are measured on the Haake-Viscotester Model VT 23:

Measuring member SV I — Rotary speed 5.8 rpm 7500 m Pa s

Measuring member SV I — Rotary speed 23.4 rpm 4000 m Pa s.

The viscosity of the mixture can be varied easily by addition of water, by addition of thickeners, or by changing the quantity of thickening medium. A change of viscosity is also possible by changing the quantity of highly disperse filler substance used. However, in this case attention must be directed in the first place to clean printing and satisfactory anchorage. As will be clear from the preceding measuring values, the dispersion paste is thixotropic, the viscosity falls as the rotary speed of the rotary member is increased. Moreover, the viscosity range within which a perfect print is produced is wide. Measured by means of the measuring member SV I and a rotary speed of 5.8 rev/min, the viscosity range can be varied between approximately 7,000 and 40,000 m Pa s.

For the purpose of heat sensitization of the preparation:

10 parts by weight: Lutonal M40, 50% solution in water (=polyvinyl methyl ether; manufacturer: BASF, Ludwigshafen)

may be added thereto. The mixture begins then to coagulate at 65°-70° C. For flocking, for example, polyamide fibers, length 1.5 mm, thickness 6.7 dTex, or cellulose wool fibers, length 1.0 mm, thickness 3.4 dTex are provided.

The apparatus according to the invention for performing the two-stage method is characterised in particular by the fact that for the first method step the charging and deposition zone which is known per se in its characteristic features is followed by a flocking zone in which flocking of the flock-binding reinforcement deposition layer occurs and by the coagulation and predrying zone in which the preliminary stabilisation of the flock layer takes place.

The treatment chain of the first method stage is grouped together in a belt installation. The next following method stage is characterised by heated chambers in which finish condensation occurs.

In an advantageous manner the endless conveyor belt of the charging zone is guided in such a manner that it forms a light-impermeable transfer gap in which the beam paths of a dense row of light barriers may be arranged. The light barriers in turn are connected to pressure-producing elements which, during deposition of the reinforcement, increase the pressure in the pressure gap, when the beam path of the light barriers is interrupted. The more beam paths are interrupted, the higher is the pressure. The possibility is given thereby to maintain constant the specific contact pressure (pressure per unit length) acting upon the fabric cutting when the width of the fabric cutting supplied changes.

Likewise in an advantageous manner a control belt may be arranged above the endless conveyor belt of the charging zone, which control belt travels together with the endless conveyor belt at the same speed and which is provided with perforations through which marking light signals are thrown upon the upper surface of the endless conveyor belt. By means of these marking light signals the operating personnel is able to place the face fabric cuttings accurately.

Owing to the lateral reciprocatory movement of the doctor hopper associated with the printing roller, uniform and complete introduction of the paste into the depressions of the engraving of the printing roller is effected even when the paste contains minor proportions of contaminations, such as remains of face fabric fibers.

In a further advantageous embodiment of the apparatus according to the invention a number of mono-filament threads which are arranged parallel to each other is attached over a portion of the periphery of the printing roller and a guide roller, the threads travelling together with the printing roller. At the same time the guide roller is arranged a little above the rolling gap between the printing roller and the counter printing roller and at a spacing behind the printing roller, so that the imprinted face fabric cutting may be released from the printing roller and safely deposited on the endless conveyor belt of the flocking zone.

In place of a number of mono-filament threads, alternatively a single endless mono-filament thread closed to form a ring may be attached which every time after leaving the guide roller runs upon the engraved roller again with lateral offset, over two respectively offset guide rollers. In this way the mono-filament thread, guided parallel on the engraved roller, migrates from the left-hand side of the engraved roller to the right-hand side thereof, from where it is guided back again to the left-hand side by way of two deflections. Conveniently the mono-filament threads or the endless mono-filament thread are cleaned of residues of reinforcing means after leaving the guide roller prior to running upon the offset guide rollers, by sliding over a continuously moistened strip of felt.

A doctor blade arranged at the peripheral surface of the counter-printing roller ensures primary removal of the excess paste from the counter printing roller. The removed paste material may thereafter be re-processed and used again. A spraying device and a further doctor blade may be located behind this first-mentioned doctor blade. By means of the spraying device the peripheral surface of the counter-printing roller can be washed clean and wiped dry by the subsequent doctor action. The liquid provided with the paste and obtained from the second cleaning process travels into a separate container.

Making the endless conveyor belt of the flocking zone permeable to the flocks, a collecting hopper may be arranged below the endless conveyor belt and the flock container, and may be constructed in the form of a suction hopper, in order that the flocks which do not fall upon the face fabric cutting can be conveyed by the endless conveyor belt and used further.

In order to remove flocks which do not adhere to the face fabric cutting, an electrostatic flock suction device may be located behind the flock hopper in the conveyance direction.

In order to ensure further removal of not-adhering flocks a pneumatic flock suction device may be connected in an advantageous manner above the endless conveyor belt of the flocking zone beyond the electrostatic flock suction device. In order that the face fabric cutting is not lifted off the endless conveyor belt in the region of this pneumatic flock suction device, a pneumatic counter-suction device is located opposite the former and below the endless conveyor belt.

Owing to the fact that the endless conveyor belt of the charging zone is wider and the counter-printing roller is axially longer than the axial length of the upper printing roller, partial imprints may also be performed on face fabric cuttings. This is ensured in a simple manner, in particular, if the drive of the printing roller and the counter-printing roller lies onesidedly on the side at which the endless conveyor belt of the charging zone and the two rollers are in line with each other. Otherwise all the conveyor belts used in the treatment chain of the first method stage have substantially the same width.

The endless conveyor belt of the flocking zone consists of a group of threads or a wide-mesh lattice belt, by means of which excess flock material can be removed in a simple manner and reliably. Multiple edge beater shafts which rotate in opposition to the travelling direction of the goods may be attached below the endless conveyor belt in the immediate flocking region. The electrostatic flocking is assisted by the vibration generated by the beater shafts.

For favoring the printing process a smoothing mechanism is advantageously located in front of the deposition zone in the region of the endless conveyor belt of the charging zone and acts upon the face fabric cuttings in order to smooth them prior to entry into the deposition zone.

DESCRIPTION OF PREFERRED EMBODIMENT

Figure 4:
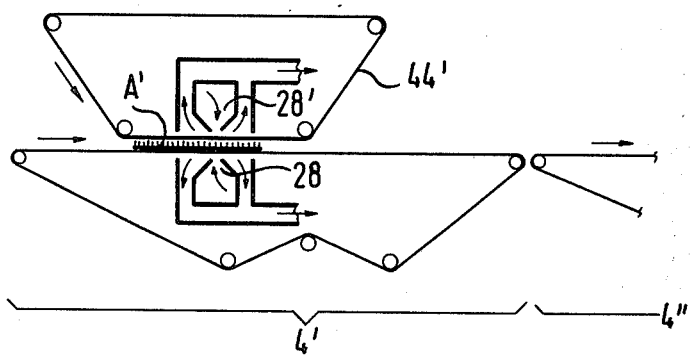
FIG. 4 is a diagrammatic side view of a re-cleaning zone beyond a coagulation and pre-drying zone.

The apparatus illustrated consists of a charging zone 1, a paste deposition zone 2, a flocking zone 3, a coagulation and predrying zone 4, a post-cleaning zone 4' and a stacking zone (indicated in FIG. 4).

An endless conveyor belt 5, as a rule edge controlled, of the charging zone 1 feeds a face fabric cutting A to two printing rollers 6 and 7 which are obliquely offset relative to each other. The printing roller 6 is an engraved roller. The counter printing roller 7 is a bare steel roller or a roller with a resiliently deformable rubber cover having a Shore hardness of from 30 to 90. Both rollers may be run under contact pressure or with a gap. The printing roller 6 possesses an engraving which may be a line engraving or as a bar engraving. The engraving lines or bars may extend parallel to the roller axis or even transversely, i.e. along the peripheral line. The edges of the engraved roller are relieved and are not engraved. A doctor hopper 8 is seated on the engraved roller 6 and is installed stationarily, but better laterally slightly reciprocatingly. By means of the doctor blade of the hopper 8 the printing paste is driven into the engraved depressions of the roller 6.

A plurality of revolving mono-filament threads 9 may be attached on the partial circumference of the engraved roller 6 and a guide roller 6'; during the passage through the printing zone 10 in the rolling gap they lift the face fabric material off the engraved roller 6. If the grooves of the engraved lines extend transversely to the axis of the printing roller 6, the mono-filament threads are advantageously guided in such grooves. The thread-guiding grooves are then to be engraved with a greater depth than the remaining engraved grooves, namely more deeply by the thickness of a mono-filament thread. Embedded in the engraved grooves, the mono-filament threads are then guided through under the doctor blade.

An edge-controlled endless conveyor belt 12 receives the imprinted cutting A from the printing roller 6 and supplies it to the flocking zone 3 within which fiber flocks are shot into the imprint on the cutting A from a flock container 13 by means of a high-tension field of from approximately 20 000 to 100 000 V which is applied between a metal grid 14 put into vibration and a grounded grid 14'. Advantageously the flock quantity supplied is such that the fiber flocks impinging upon the cutting A are anchored without considerable excess. The flocks which fall out of the flock container 13 beyond the edge of the cutting A are drawn into a suction hopper 15, collected, and used again. Downstream of the flock container 13, there is an electrostatic flock suction device 16 beyond which a pneumatic flock suction device 17 may be disposed. In order that the cutting A is not lifted off the carrier belt 12, a counter-suction device 18 is provided under the carrier belt at the position of the pneumatic device 16.

After leaving the flocking zone 3 the imprinted and flocked cutting A travels into the zone 4 in which coagulation and/or pre-drying takes place. Beyond the zone 4 the flocked cutting A' (FIG. 4) travels to the post-cleaning zone 4' which comprises a belt above which a second belt 44' is guided at the same speed. Both belts are air-permeable and grip the incoming flocked cutting A' between them. The cutting is cleaned from both sides by blowing thereover compressed air. The air which has issued from compressed air slots 28 and 28' may be sucked away at the sides of the slots. Finally a stacking device (not shown) in the zone 4'' ensures clean stacking of flocked cutting A.

The coagulation pre-drying zone 4 disposed beyond the flocking zone 3 has an endless conveyor belt 25 which follows immediately beyond the endless conveyor belt 12 of the flocking zone 3, an IR radiator 26 arranged thereabove, and a suction device 27 arranged therebelow.

Figure 2:
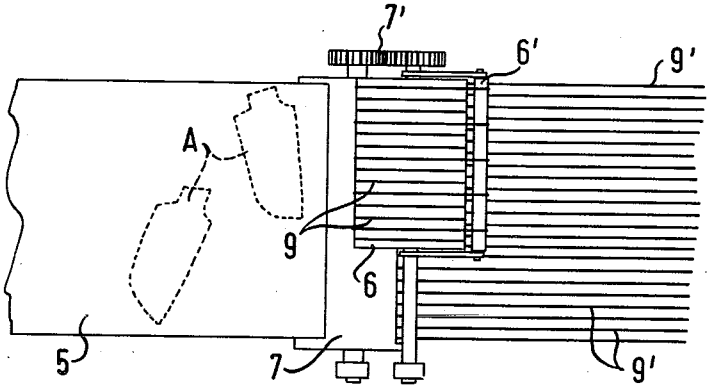
FIG. 2 is a diagrammatic plan view of a deposition zone and adjacent sections of a charging and flocking zone.

Since the supply belt 5 and the counter roller 7 extend beyond the ends of the printing roller 6, partial imprints may also be performed on the face fabric cuttings A, as indicated in the lower part of FIG. 2.

The gearwheel engagements 7' of the two rollers 6, 7 are therefore located on only one side. The pair of printing rollers may be traversed laterally by the upper part of a cutting A. The subsequent belts 12, 24, 25 have the same width as the endless conveyor belt 5 of the charging zone 1. The belt 12 of the flocking zone 3 may be constructed as a group of threads through which the excess flocks drop through more easily. In FIG. 2, such a group of threads 9' is indicated. In place of the group of threads a wide-mesh lattice belt may alternatively be used.

Figure 3:
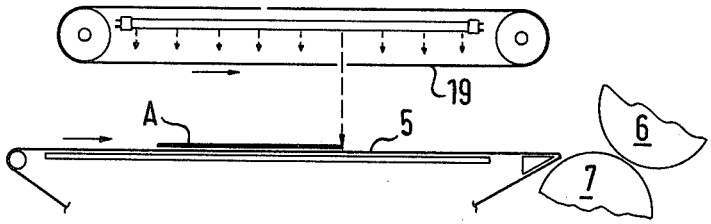
FIG. 3 is a diagrammatic side view of a portion of a charging zone provided with an optical control.
Figure 5:
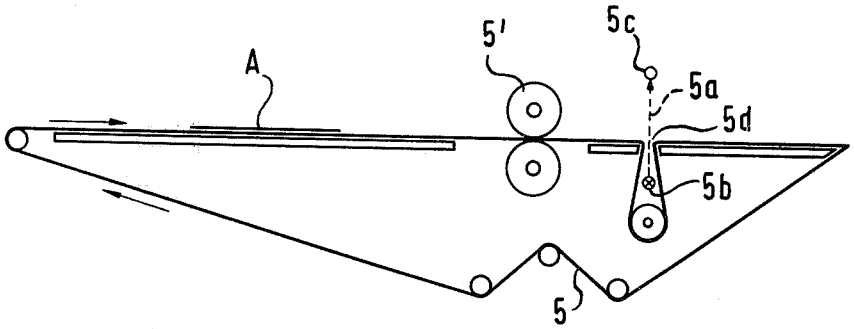
FIG. 5 is a diagrammatic side view of light barriers for sensing occupation of the endless conveyor belt.

As a rule the counter roller 7 is driven during the printing process against the printing roller 6 by means of compressed air cylinders connected to the ends. Adjustable abutments at both ends permit operation with an accurate gap, if the counter roller 7 is a steel roller; if the counter roller 7 is rubber coated, they permit adjustment to any desired area impression into the rubber coating by means of the engraved roller. Additional control devices on the charging side may be provided, which sense occupation of the endless conveyor belt 5 by face fabric cuttings A optically by means of a dense row of light barriers. In this case (FIG. 5) transfer gap **5*d* of the endless belt 5 is illuminated from below by light beam sources or by reflectors of the light barriers, and receivers 5*c* intercept the beams which have passed through. Pressure signals are transmitted by the light beams by way of pressure-delivering elements to the printing rollers, so that with increased occupation (wider face fabric cutting, smaller light beam passage) a higher total pressure, and with lower occupation (higher beam passage) a lower total pressure is adjusted. Thereby it can be ensured that the pressure per unit length remains always the same. Such a control device is unnecessary for a rubber-coated counter roller having a Shore hardness of from approximately 30 to 40. Furthermore it is possible to throw upon the charging belt light signals which travel therewith at the same speed and which arrive from a control belt 19 which is penetrated by light and is provided with perforations and which travels above the charging belt 5 and possesses the speed thereof (FIG. 3). The light signals serve as marking or reference points for the operating personnel for accurate placing of the face fabric cuttings. The printing rollers receive the command to open as soon as the face fabric cutting has reached the printing zone 10** by that region which is not to be imprinted, and furthermore the command to close, as soon as the region to be imprinted of the face fabric cutting travels into the printing gap. The control belt perforations penetrated by light and the succession in time of the commands to the pair of printing rollers are accurately adjusted one to the other. However, the device is unnecessary in normal operation.

The counter roller 7 is provided with two doctor blades 20, 21. The doctor blade 20 wipes off the paste which has not been printed upon the cutting A, but upon the counter roller 7. The excess paste travels from a conduit 20' connected to the doctor blade 20 into a collecting container. After cleaning by means of a filter, the excess is used again. A water spray pipe 20 which cleans the counter roller 7 is located between the doctor blades 20 and 21. Finally the doctor blade 21 wipes the counter roller 7 dry. The spray water flows away into a trough 23 located therebelow, which also intercepts the cleaning water applied to both rollers after the operation of the whole installation has been stopped.

Figure 1:
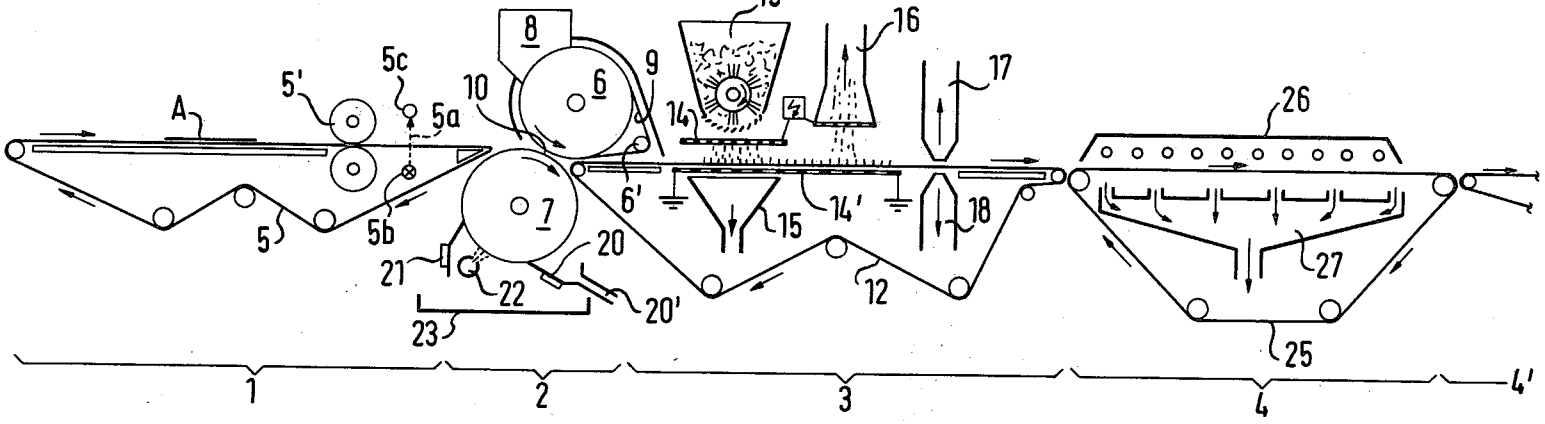
FIG. 1 is a diagrammatic side view of the apparatus for performing the first method stage.

In the region of the endless conveyor belt 5 of the charging zone 1 there is located a smoothing mechanism 5' (FIG. 1) which consists of two rollers which lie against the belt 5, one from above and the other from below. In case it is required, smoothing of the incoming cuttings A may be performed with this smoothing mechanism 5', as the cuttings together with the belt 5 travel through the rolling gap of the two rollers of the mechanism 5'. The printing ability may improved by this smoothing process.

The engraving of the printing roller 6 may consist of line-shaped grooves having a depth of from approximately 0.4 to 0.6 mm with a tapering or semicircularly rounded cross-section. At the bottom the tapering grooves are approximately 0.6 mm wide, at the top approximately 1.2 mm wide. The ledge width between the grooves is approximately 1.1 mm. However, alternatively the spacings of the grooves and their dimensions may be selected smaller.

With a face fabric material of wool gabardine having a weight of approximately 210 g/m$^2$, approximately 105 g/m$^2$ printing paste, corresponding to a dry paste weight of approximately 60 g/m$^2$, is deposited by the engraving referred to above and the printing paste referred to above when a rubber-coated lower roller having a Shore hardness 40 is used which only just contacts the printing roller. The deposition weight may be varied by the application of different engravings, spacings, pressures, and lower rollers. Suitable deposition quantities lie in the range between 40 and 90 g/m$^2$ dry weight, to which are added the flock quantity.

The reinforcing effect and the grip are controllable not only by the deposition quantity of printing paste. Even by changing the paste prescription and in this respect in particular by changing the fundamental resins, dispersions, and additives, the reinforcing effect and the grip may be varied within wide limits. Furthermore, they are also influenced by the kind, quantity, and anchorage of the flock fibers.

The face fabric materials referred to in the present invention are understood to be all kinds of flat structures which can be used for articles of outer clothing. The face fabric materials may consist of woven fabrics, knitted fabrics, and fleeces as well as leather-like, fur-like, and related materials.

I claim:

1. A method of reinforcing a face fabric material for a garment by a layer of flocking on the rear side of the face fabric to eliminate the need for a fixing lining for the garment, comprising the steps of imprinting the back of the material with an aqueous cross-linkable dispersion paste in a grid-like manner by an intaglio printing process, applying flock to the dispersion paste and curing by heat treatment, characterized in that:

(a) the printing step is performed with a flock binding dispersion paste on fabric cuttings:

(b) the flock is applied to the dispersion paste electrostatically;

(c) the aqueous dispersion paste is pre-stabilized by at least one technique selected from thermal coagulation and pre-drying: and (d) a further operating stage in which the step of cross-linking the dispersion paste is carried out with a plurality of cuttings positioned to form a stack in a heated chamber at 90° to 140° C.

2. The method of claim 1, in which the dispersion paste incorporates at least one highly disperse filler substance having an average surface area of 25 to 600 m$^2$/g referred to the dry weight of the dispersion paste.

3. The method of claim 2, in which the said average surface area is 50 to 400 m$^2$/g.

4. The method of claim 2, in which the filler substance amounts to 0.5 to 5% by weight, referred to the dry weight of the dispersion paste.

5. The method of claim 1, in which the filler substance is a dry-cleaning resistant, wear resistant filler substance produced by decomposition of a halogenide in the gas phase.

6. The method of claim 1, in which at least one filler substance is selected from the group consisting of silicic acid, aluminum oxide, and titanium dioxide.

7. The method of claim 1, in which the dispersion paste comprises at least one cross-linkable co-polymersate into which has been polymerised at least one divinyl compound up to a maximum of 3% referred to dry weight.

8. The method of claim 1, in which the dispersion paste comprises at least one cross-linkable co-polymerisate pre-condensed with at least one bifunctional hardener up to a maximum of 4% referred to dry weight.

9. The method of claim 8, in which the said at least one hardener is selected from the group consisting of dimethylol ethylene urea and dimethylol propylene urea.

10. The method of claim 8, in which the at least one cross-linkable co-polymerisate is pre-condensed with at least one water-soluble resin with carbonic acid amide groups in the polymer molecule at a proportion of resin up to a maximum of 4% and with at least one bifunctional hardener up to a maximum of 3% referred to dry weight.

11. The method of claim 1, in which the flock is applied in an electrostatic direct current field of 20 to 100 kV.

12. The method of claim 1, in which the dispersion paste is a heat sensitive dispersion paste which coagulates below 100° C., preferably between 45° and 80° C.

13. The method of claim 1, in which the quantity of flock applied amounts on average to 5 to 20%, preferably 7 to 15%, of the dry weight of the paste.

14. The method of claim 1, in which the flock comprises fibers 0.5 to 2.0 mm long.

15. The method of claim 1, in which the flock comprises fibers having a thickness of 0.9 to 10 dTex, preferably 3 to 8 dTex.

16. The method of claim 1, in which the flock comprises synthetic fibers preferably polyamide-based.

17. The method of claim 1, in which the dispersion paste comprises at least one cross-linking synthetic resin selected from the group consisting of co-polymerisates based on acrylic acid esters, on methacrylic acid esters, and on acrylic and methacrylic acid esters, and other polyacrylates.

18. The method of claim 1, in which the dispersion paste is foamable.

19. The method of claim 1, in which step (c) is carried out at a lower temperature than step (d).

20. The method of claim 1, in which, after the application of flock, the dispersion paste is first heated to below 80° C. and thereafter to 90° to 140° C., preferably 100° to 130° C.

21. The method of claim 1, in which, after the application of flock, the dispersion paste is heated by at least one means selected from the group consisting of hot air, infra-red radiators, and micro-wave radiators.

22. The method of claim 1, in which the pieces are stacked between molds.

23. The method of claim 1, further comprising, before step (d), an intermediate stage comprising sewing and ironing the material.

24. The method of claim 1, in which said step of cross-linking the dispersion paste is carried out at 100° to 130° C.

* * * * *